US009366247B2

(12) United States Patent
Klaus

(10) Patent No.: US 9,366,247 B2
(45) Date of Patent: Jun. 14, 2016

(54) METHOD FOR INTELLIGENT CONTROL OF A COMPRESSOR SYSTEM WITH HEAT RECOVERY

(75) Inventor: Frank Klaus, Simmern/Hunsruck (DE)

(73) Assignee: GARDNER DENVER DEUTSCHLAND GMBH, Bad Neustadt (DE)

( * ) Notice: Subject to any disclaimer, the term of this patent is extended or adjusted under 35 U.S.C. 154(b) by 653 days.

(21) Appl. No.: 13/450,002

(22) Filed: Apr. 18, 2012

(65) Prior Publication Data

US 2012/0315158 A1 Dec. 13, 2012

(30) Foreign Application Priority Data

Apr. 18, 2011 (DE) ..... 10 2011 017 433

(51) Int. Cl.

| | |
|---|---|
| ***G05D 7/00*** | (2006.01) |
| ***F04B 39/06*** | (2006.01) |
| ***F28D 15/00*** | (2006.01) |
| ***F04B 49/06*** | (2006.01) |
| ***F04B 39/02*** | (2006.01) |

(52) U.S. Cl.
CPC ..... *F04B 49/065* (2013.01); *F04B 39/02* (2013.01); *F04B 39/062* (2013.01)

(58) Field of Classification Search
CPC ..... F04B 39/062; F04B 49/065
USPC ..... 700/282
See application file for complete search history.

(56) References Cited

U.S. PATENT DOCUMENTS

| | | | | |
|---|---|---|---|---|
| 5,197,537 | A * | 3/1993 | Chigira et al. | 165/291 |
| 5,318,151 | A | 6/1994 | Hood et al. | |
| 5,495,723 | A * | 3/1996 | MacDonald | 62/183 |
| 5,775,883 | A | 7/1998 | Hattori et al. | |
| 6,139,280 | A | 10/2000 | Holt et al. | |
| 2004/0217180 | A1 | 11/2004 | Lu | |
| 2005/0155373 | A1 | 7/2005 | Hirooka et al. | |
| 2009/0120110 | A1 * | 5/2009 | Grabon et al. | 62/115 |

(Continued)

FOREIGN PATENT DOCUMENTS

| | | | |
|---|---|---|---|
| CN | 2677669 | * | 2/2005 |
| CN | 2677669 | Y | 2/2005 |
| CN | 101435420 | * | 11/2007 |

(Continued)

OTHER PUBLICATIONS

German Search Report for DE 10 2011 017 433.8.

(Continued)

*Primary Examiner* — Mohammad Ali
*Assistant Examiner* — Yuhui R Pan
(74) *Attorney, Agent, or Firm* — Michael Best & Friedrich LLP

(57) ABSTRACT

The invention relates to a control for heat recovery (WRG) in a compressor system with liquid injection comprising a fluid circuit of the fluid which is to be injected with control valve, this fluid passing through at least one heat exchanger with control valve to the WRG and upstream of the compressor (13) of the compressor system there being a compressor-side control valve (6) and downstream of the heat exchanger (9) of the WRG there being a WRG-side control valve (7), one electronic control unit (11) controlling at least one of these control valves (6 and/or 7) by means of an algorithm, and the required temperatures for the mass flows [4, 5] of the WRG being able to be input as parameters into the control unit [11].

8 Claims, 3 Drawing Sheets

(56) References Cited

U.S. PATENT DOCUMENTS

| | | | | |
|---|---|---|---|---|
| 2009/0138129 | A1* | 5/2009 | Setoguchi | 700/282 |
| 2011/0000227 | A1 | 1/2011 | Kamiya | |

FOREIGN PATENT DOCUMENTS

| | | | |
|---|---|---|---|
| CN | 101 435 420 | A | 5/2009 |
| CN | 101435420 | A | 5/2009 |
| DE | 4439780 | A1 | 5/1996 |
| DE | 10 2005 053 589 | A1 | 5/2007 |
| DE | 102005053589 | A1 | 5/2007 |
| EP | 0725255 | A2 | 8/1996 |
| JP | S61179387 | A | 8/1986 |
| JP | H03204569 | A | 9/1991 |
| JP | H06213188 | A | 8/1994 |
| JP | 2000-205163 | | 7/2000 |
| JP | 2000205163 | A | 7/2000 |
| JP | 2008088868 | A | 4/2008 |
| WO | 9421921 | A1 | 9/1994 |
| WO | 2006039580 | A1 | 4/2006 |
| WO | 2007045052 | A1 | 4/2007 |

OTHER PUBLICATIONS

European Search Report for related case EP 12 16 4183.1, dated Jan. 29, 2015, Written Opinion, and Statement About Written Opinion for EP 12 16 4183.1 (8pgs.).

1st Office Action from the State Intellectual Property Office of the People's Republic of China for Application No. 201210243241.X dated Apr. 27, 2015 (12 pages).

European Search Report from the European Patent Office for Application No. 12164183.1 dated Feb. 10, 2015 (3 pages).

* cited by examiner

Fig. 1

| Control of the cooling fluid temperature | Compressor in | Delta T injected fluid [°C] | Injection temperature fluid [°C] | Temperature after compression fluid [°C] | Customer wish, for example service water | | Temp. water ACTUAL OUT [°C] | Delta T Water ACTUAL, Delta T water, customer wish in % |
|---|---|---|---|---|---|---|---|---|
| | | | | | Temp. water IN[°C] | Temp. water OUT[°C] | | |
| Conventionally 70° | Full load | 17 | 70 | 87 | 55 | 95 | 82 | 68 |
| Control valve intelligent | Full load | 17 | 83 | 100 | 55 | 95 | 95 | 100 |
| Conventionally 70° | Partial load | 4 | 70 | 74 | 55 | 95 | 69 | 35 |
| Control valve intelligent | Partial load | 4 | 96 | 100 | 55 | 95 | 95 | 100 |

METHOD FOR INTELLIGENT CONTROL OF A COMPRESSOR SYSTEM WITH HEAT RECOVERY

Due to the general depletion of energy resources worldwide and as a result of the climate discussion with reference to $CO_2$ emission, a general trend toward efficient energy use and energy conservation can be ascertained at present. Efforts to handle natural resources more sparingly are also considerable in the compressor industry.

The following invention relates to a method for intelligent control of a compressor system with liquid injection which is equipped with heat recovery for purposes of maximizing efficiency.

Chinese publication CN 101 43 5420 (A) discloses a system for heat recovery and circulation on an air compressor. Here a system is disclosed which effects cooling of the air compressor by means of cooling water, encompassing a fluid circuit of the fluid which is to be injected, this fluid running through at least one heat exchanger to the WRG [heat recovery], upstream of the compressor of the compressor system there being a control valve and downstream of the heat exchanger of the WRG there being a WRG-side control valve and one electronic control unit controlling at least one of the two control valves by means of an algorithm and the required temperatures for the mass flows of the WRG can be input as parameters into the control unit. It is the object of this disclosure to control the temperature of the cooling water and thus to implement good heat recovery.

The control valve which is located upstream of the compressor is in any case attached directly to the cooler and thus cannot be regarded as a control valve which is controlled by an electronic control unit and which is located in the compressor. The compressor system which is disclosed here with liquid injection is therefore equipped with heat recovery, but intelligent control with the objective of maximizing efficiency is not possible.

Here attention is on effective cooling of the air compressor, and only better heat recovery is to be achieved by the invention, the means used for this purpose remaining open. The focus remains the cooling of the air compressor. It will simply be implemented that the discharged energy is also efficiently used. In spite of all this, the system is furthermore geared only to the requirements for ideal operation of the air compressor.

The publication CN 2677669 describes an oil-injected compressor with heat recovery. It is disclosed here that the heat recovery precooled [sic] the used oil after its separation in order in this way to avoid adverse effects of high temperature with respect to the compressor and especially to the service life of the oil used. It is moreover disclosed that efficient use of the exhaust heat of the compressor is achieved by this heat dissipation from the heated oil and thus a contribution is made to climate protection.

Mechanically for this purpose an oil temperature control valve is provided which can be regarded as a compressor-internal valve, but it is not electronically controlled. In this way however a control for heat recovery in the sense of this invention which is aimed both at the cooling of the compressor and also at energy savings of the overall system as large as possible cannot be implemented.

Here the orientation of the system in its basic idea to the ideal operating state of the compressor is also exhausted, the injected oil undergoing a temperature rise depending on the load state of the compressor, which is usefully withdrawn again from the oil by the heat recovery. hi this publication both the service life of the oil will be achieved by a more uniform temperature of the compression as well and at the same time a contribution to climate protection will be made.

But in this case this does not answer the question whether the heat recovery is optimized in any form, or whether it can proceed at a constant level. It is rather a matter of keeping the oil and thus the operating parameters at a certain level via heat recovery.

FIG. 1 is a table illustrating a comparison of the energy recovery of a conventionally controlled WRG and a WRG controlled according to one embodiment of the disclosure.

Figure 2:
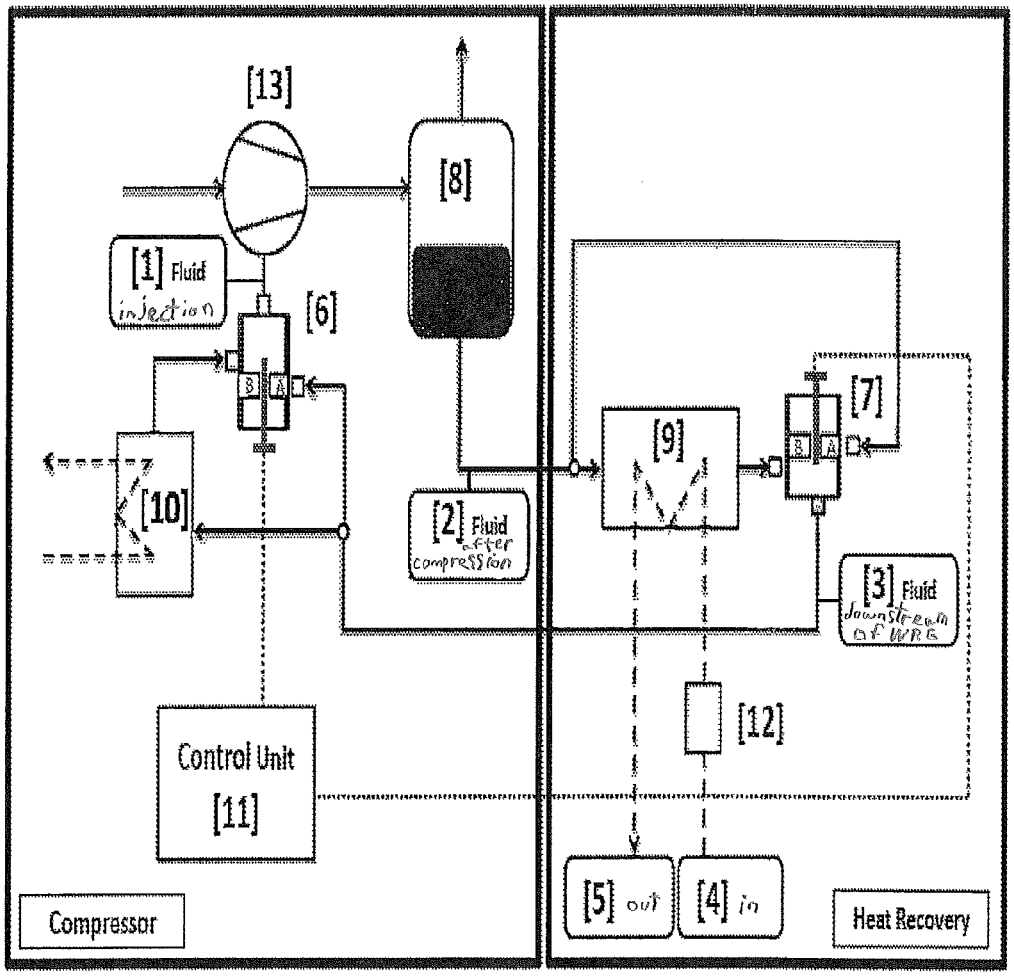
FIG. 2 is a schematic view of a compressor circuit according to one embodiment of the disclosure.

Reference is made to the attached schematic of the system with the indicated reference numbers in the following. Conventionally the fluid [1] (oil or water) which has been injected for lubrication and cooling in a compressor stage [13] after compression of the air on the pressure side is separated from the compressed air. A separator [8] separates the compressed air from the fluid, the separated fluid being returned again to the intake side of the compressor in a circuit. In doing so the fluid in systems without WRG is cooled back to the desired temperature level for re-injection in an internal heat exchanger [10] (water-cooled or air-cooled).

A compressor-side control valve [6] adjusts the fluid injection temperature [1] to the desired fixed value. For this purpose, in the prior art for example oil temperature regulators as 3/2-way valves are used in which a slide which has been actuated by a wax element controls the inflow. The oil temperature regulator controls the temperature of the oil within a set temperature range and only ever supplies to the cooler as much oil as is needed to reach the desired oil temperature before injection.

In a fluid-injected compression system according to the prior art, an attempt is made to inject the fluid as cold as possible into the compressor stage [13] in order to reduce its power consumption. This means that the emphasis is primarily on performance optimization of the compressor system.

But if the compressor system with WRG is examined, the power consumption of the compressor stage [13] is no longer evaluated alone, but the entire system consisting of the compressor and WRG is examined. It was ascertained here that it can be a good idea to operate the compressor not at the performance-optimum point. In order to optimize the energy balance of the system overall [sic].

The temperature of the injected fluid influences not only the efficiency of the compressor stage, but also the temperature of the compressed air in the separation tank [8] and at the same time the temperature of the fluid after compression [2]. In compressor systems with WRG this fluid [2] which has been heated by the compression process is supplied to an external heat exchanger [9] for heating of a mass flow [4, 5] and in this way is itself cooled again.

In order to prevent possibly overly strong cooling of the fluid and thus of the compressor by the WRG, in addition to the compressor-side control valve [6] the exit temperature of the fluid [3] from the heat exchanger [9] of the WRG is limited downward with a separate WRG-side control valve [7]. In doing so compressor-side and WRG-side control valve [6 and 7] must be matched to one another to prevent the fluid temperature downstream of the WRG [3] from dropping below the desired fluid injection temperature [1]. If the WRG is not required, the internal heat exchanger [10] assumes the cooling function of the compressor.

In practice, to control the fluid injection temperature [1] permanently installed control valves [6, 7] with permanently defined control temperatures are used nowadays.

In practice, a situation arises in which the temperature of the fluid after compression [2] is either too low or too high for the WRG since the requirements for a WRG depend very dramatically on the requirements and conditions of use of the user, i.e. each user requires different entry [4] and exit temperatures [5] for his mass flow, for example for service water heating. These desired temperatures can then also change over time or are often known by the user only when the compressor is installed.

For speed-controlled compressors the temperature of the fluid after compression [2] decreases considerably (15-20° C.) at lower rpm or the degree of heating of the fluid in the compression process, for which reason under certain circumstances the fluid temperatures which are required for the desired WRG after compression are only available under full load conditions.

Thus, in operation of the compressor system depending on the influencing parameters named here, the temperature level of the fluid after compression [2] which is required for the WRG, depending on the load operation of the compressor, will deviate greatly from the required temperature or will vary greatly. At an overly low fluid temperature following compression and upstream of the WRG, thus in real operation of the compressor system only about 35-90% of the possible energy is recovered.

And on the other hand overly high fluid temperature [2] which is not required for the desired temperature level of the WRG leads to increased power consumption of the compressor stage of only roughly 2-5% since the WRG does not suitably cool down the fluid before entry into the compression process.

It is therefore the object of this invention to devise a system in which the temperatures which are necessary for the user for the mass flows [4, 5] of the WRG can be input as parameters into a control unit [11].

An algorithm which is filed in the control unit via at least one control element [6, 7] at a time controls the fluid exit temperature after compression [2] and the fluid exit temperature downstream of the WRG [3] such that exactly the temperature level is reached which is required by the customer in order to recover the desired amount of heat of the system. The plus of heat energy [10-65%] is distinctly higher than the somewhat increased power demand of the compressor stage (roughly 2-5%) due to an increased fluid injection temperature [1].

On the other hand, for example the temperature level can be lowered again when heat is temporarily not being removed by the WRG in order to again reduce the performance of the compressor.

The energy savings which can be achieved by this intelligent control is on the order of 2-60%.

In another configuration of the invention or also in a supplementary 2nd step it is expedient to also incorporate the control of the mass flows of the WRG of the user into the system with respect to maximum efficiency. Alternatively to the fluid exit temperature following compression [2] the desired exit temperature of the customer mass flow [5] could be directly controlled as the control variable. Moreover a volumetric flow control of the customer mass flow by a control element [12], for example a throttle valve, which ensures a uniform temperature level, can be imagined.

The desired temperature (5) of the medium which has been heated by the WRG in the control unit (11) is used as the initial parameter for controlling the temperature of the fluid following compression [2]. The setpoint temperature of the fluid after compression [2] is thus for example fixed by the desired cooling water temperature of the user. If this cooling water is to reach for example a setpoint temperature of 95° C., the setpoint value of the fluid temperature after compression [2] is calculated at 95° C.+roughly 5° C.=100° C.

The table of FIG. 1 shows by way of example a comparison of the energy recovery of a conventionally controlled WRG and the intelligently controlled WRG as claimed in the invention.

In the conventionally controlled WRG in the example computed here 35% or 68% of the technically usable energy can be recovered, in an intelligent control 100%.

A sample calculation of possible additional cost savings by an intelligently controlled WRG is shown below.

The point of departure is an oil-injected screw compressor with 90 kW rated output with a technically maximum possible recoverable heat at roughly 80% of the rated output of 0.8×90 kW=72 kW.

The annual cost savings at 100% heat recovery by the intelligently controlled WRG as claimed in the invention is computed with the following parameters 4000 Bh/a
0.6 euro/liter fuel oil
heating efficiency: 75%
upper heat value of fuel oil: 10.57 kWh/l)

$$\frac{72\text{kW} \times 4000\ Bh/a \cdot 0,6\ Euro/l}{(10,57\text{kWh}/l \cdot 0,75)} = 21.798\ Euro/a$$

The annual cost savings at 35% heat recovery by a conventionally controlled WRG is computed as $$0.35 \times 21,798\ \text{euro/a} = 7,629\ \text{euro/a}$$

The additional savings by an intelligent control WRG is accordingly in this exemplary case roughly 14,168 euro/year.

The invention will be detailed below using two schematic drawings in two designs.

On the one hand, the schematic of FIG. 2 on the left side shows the compressor 13 into which a fluid is injected in the operating state 1. Following compression, this fluid is separated in a separator 8 from the compression medium and as a fluid in the operating state 2 after compression is transferred into the second region of the system which is shown on the right, specifically to that of the heat recovery (WRG).

In this section the fluid which has been heated by the compression process in the operating state 2 enters at elevated temperature compared to the operating state 1 since depending on the load state of the compressor a defined heating of the injected fluid takes place in the compression process. This heated fluid is now supplied to heat recovery in a heat exchanger 9, as a result of which it emerges again after passing through this heat recovery process in the operating state 3 cooled by a certain value which is to be defined.

In the schematic on the right side there are thus a heat recovery region and on the left side a compression region of the system as claimed in the invention. In this connection, on the compressor side the internal heat exchanger 10 for regulation of the temperature of the fluid before injection is arranged in series with the heat exchanger 9 which is located on the WRG side. Within the heat recovery there is a control valve 7 in the illustrated embodiment connected downstream of the heat exchanger 9; the fluid which has been cooled after heat recovery is routed through by the valve.

This valve can be electrically controlled as claimed in the invention, for example by an electric stepping motor which replaces the conventional expansion material element, and has two inputs A and B. Input A is an input here through which the fluid in the operating state 2 can be supplied bypassing the heat recovery for regulation of the temperature of the fluid in the operating state 3 after heat recovery.

Input B is an input into the control valve 7 by which the fluid after heat recovery enters in the cooled state. That is, a mixing of the fluids in the operating state 2, i.e. with elevated temperature and in the operating state 3 after heat recovery, is possible via the control valve 7 in order to control the temperature which the fluid has in the operating state 3 after heat recovery.

The heat exchanger 9 thus has a cooling medium, for example water which in the operating state 4 before entering the heat exchanger 9 is the operating state 5 with elevated temperature after passing through the heat exchanger 9.

In the illustrated schematic moreover there is an additional control element 12, for example a throttle valve, in the feed of the heat exchanger 9 by which the flow through the heat exchanger 9 can be controlled with the medium which is to be heated. This is also used for control of the exit temperature of the fluid in the operating state 3 after heat recovery. When the flow rate of the cooling medium is reduced in the heat exchanger 9 there is a higher exit temperature in the fluid after heat recovery.

The fluid in the operating state 3 after heat recovery is supplied again to the compressor side of the system since it is routed into the compressor 13 in a circuit for re-injection. Before injection into the compressor 13 another control valve 6 is part of the system which is likewise electrically controlled. This control valve 6, depending on the desired entry temperature 1 of the fluid for injection into the compressor 13, can relay either the fluid in the temperature in the operating state 3 after heat recovery or can undertake control to reduce the temperature.

Like the control valve 7, the control valve 6 for this purpose also has two inputs, specifically the input A, by which the fluid in the operating state 3 at a certain temperature level is supplied after heat recovery and thus is supplied to injection.

A cooler 10 is connected upstream of the second input B and can reduce the temperature of the fluid in a defined level. Thus a mixing ratio of the fluid between the higher temperature in the operating state 3 and the more cooled temperature after passing through the cooler 10 can be set by defined opening of the inputs A and B and thus the fluid in the operating state of injection 1 can be exactly set to the desired temperature.

For various operating states of the system corresponding measures can be taken via control of valves 6 and 7. In general operation of the heat recovery there are possibilities for operating the valve 7 exclusively via the input B or from a mixture of inputs A and B and thus for determining the initial temperature 3 of the fluid after heat recovery.

At the same time, both operating states of the valve 6 likewise apply when using heat recovery, specifically an exclusive flow through the input A or a connection of the input B and thus a defined cooling of the fluid before injection into the compressor 13.

If the heat recovery is temporarily not operated, the fluid 2 can be completely routed through input B after compression or also in a mixed form through input A and B or also completely bypassing the heat recovery exclusively through input A since the heat recovery does not take away temperature and thus the temperature after heat recovery remains the same depending on the valve position of the control valve 7. In this control case the control valve 6 can be operated in the position of use of the two opened valves A and B or in the exclusive opening of the input B since generally cooling of the fluid will be fundamentally necessary in the case of heat recovery which does not take place.

Other valve positions arise from the operating states of heat recovery which are to be raised in the temperature of use, or depending on the requirement also lowered. In a desired raising of the temperature of use of heat recovery it is feasible to regulate the position of inputs A and B in valve 6 before injection to an increased flow through the input A in valve 6 since in this way the injection temperature of the fluid in the operating state 1 is raised upstream of the compressor by bypassing the cooler 10. The increased injection temperature of the fluid yields a higher fluid temperature 2 following compression and thus a higher entry pressure before heat recovery, as a result of which a higher temperature can be supplied to the heat recovery.

A further control component can be alternatively or additionally achieved in that at the same time with a displacement toward the inlet A into the valve 6 or to exclusive routing of the fluid in the operating state 3 via the input A of the valve 6, throttling of the cooling medium in the throttle valve 12 takes place during heat recovery 9. By reducing the flow rate through heat recovery a higher temperature level can also be assigned to the medium to be heated.

Conversely it would be possible to reduce the useful temperature of the heat recovery by a displacement toward the input B of the valve taking place in the control valve 6 before injection, i.e. more of the fluid is routed via the cooler 10 in the operating state 3 after heat recovery and thus the temperature prior to injection of the fluid 1 is reduced. The reduced injection temperature 1 yields a reduction of the temperature 2 after separation in the separator 8 after compression prior to heat recovery 9. This means that fluid with a lower temperature enters the heat exchanger 9, as a result of which here the temperature level in the medium to be cooled can be reduced at the output 5.

Alternatively or in addition the use of a throttle valve 12 before entry into the heat recovery is possible here, in this case a lower temperature level can be attained at the output 5 by a higher flow rate of the medium which is to be cooled through the heat recovery 9.

Furthermore the system as claimed in the invention can react to changes in load operation of the compressor 13 in order to be able to keep the desired use of heat recovery at a defined level. Here it is a central concern of the invention to make the heat recovery optimum in terms of energy and thus to achieve a clearly better energy yield of the system of compressor and heat recovery.

If the load operation of the compressor 13 is run down, this results in that the increase of the fluid temperature decreases in the compression process. After separation of the working medium in the separator 8 the fluid temperature 2 after compression is thus lower. In order to be able to optimally use the temperature for heat recovery, it is necessary to further open the input A of the control valve 6 since the fluid in the control circuit fundamentally has a lower temperature and thus does not require cooling via the cooler 10 and thus the input B of the control valve 6.

By bypassing the cooler 10 at the input 1 of the fluid into the compressor 13, a higher temperature can be reached. The heat recovery process in the heat exchanger 9 should cause a desired heat of the medium to be heated after passing through the heat recovery in state 5. Therefore the fluid is completely supplied to the heat recovery and is not routed around the heat recovery in the bypass via input A of the control valve 7. Maximum heat use for the heat recovery will thus be enabled.

In order to keep the medium which is to be heated constant in its temperature in the operating state 5, moreover in one advantageous design the throttle valve 12 can be actuated in order to reduce the flow rate of the medium to be heated through the heat exchanger 9 such that the temperature in the state 5 after heat recovery reaches the desired value.

Conversely, running up the load operation of the compressor 13 causes a temperature rise of the compressor fluid after compression 2 and after separation in the separator 8. The fluid in the operating state 2 thus has a higher temperature, possibly higher than necessary for the heat recovery in the heat exchanger 9. As in the previous exemplary case, it is not expedient to use the inlet via input A of the control valve 7 since in this way the heat dissipation of the fluid by heat recovery does not take place. An increased flow rate of the medium to be heated via the throttle valve 12 through the heat exchanger 9 is expedient in order to adapt the medium in the state 5 in its temperature upon emergence 5 from the heat exchanger 9.

One decisive control point in this operating state is the position of the control valve 6 since here the input temperature of the fluid can be set to a desired value in the operating state 1 before compression by increased bypass of the fluid in operating state 3 via the cooler 10 and thus into the input B of the control valve 6. This means that by cooling the fluid before injection 1 into the compressor a certain fluid temperature after compression in the operating state 2 is set which corresponds exactly to inputs in order to reach the desired temperature of the working medium after passing through the heat exchanger 9 in the operating state 5.

Measuring elements which are necessary for supply of the control unit with the required operating parameters are not shown in the drawings. Temperature measuring elements are intended here at least for the fluid temperature 2 after compression and the fluid temperature 3 downstream of the WRG. Furthermore it is expedient to measure the water temperature 5 downstream of the WRG since it is to maintain a desired value. If the input temperature 4 upstream of the WRG should likewise be variable, there should also be a measuring element here.

Figure 3:
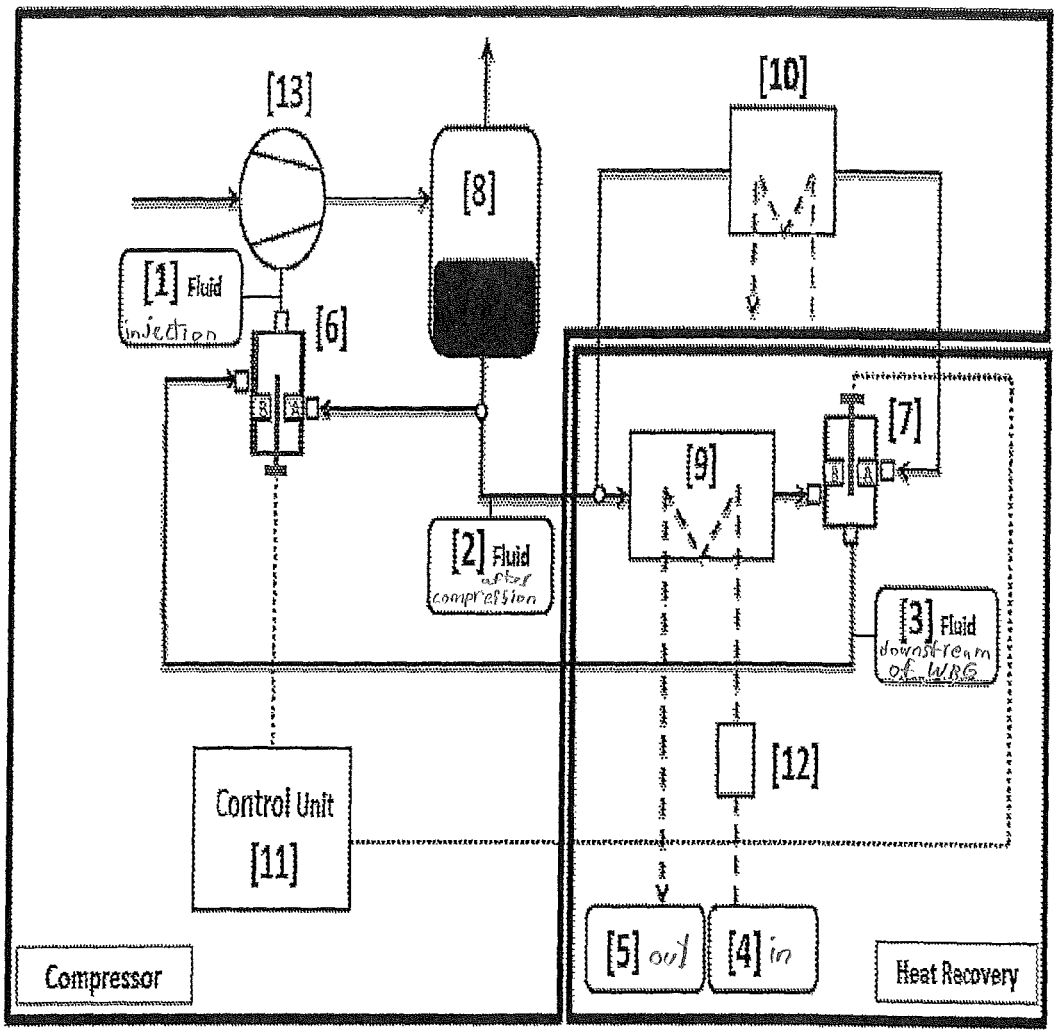
FIG. 3 is a schematic view of a compressor circuit according to another embodiment of the disclosure.

FIG. 3 shows one alternative design of the system in which at this point the heat exchanger 10 located previously as internal on the compressor side is no longer connected in series to the heat exchanger 9, but has a parallel arrangement to the heat exchanger 9. This means that fluid 2 after compression and with the temperature increased by the compression process for heat recovery passes through the heat exchanger 9, as described above, but can also pass through the second heat exchanger 10 and can be supplied to the control valve 7 through input A for controlling the injection temperature 1 and the fluid temperature 2. In this way it is possible to cool the fluid 3 again after heat recovery, depending on the desired operating parameters.

It is provided in this design for the control valve 6 that on the one hand the fluid 3 in the temperature state after heat recovery is supplied to the control valve, as already previously. This time there is input B into the control valve for this purpose, in contrast to the previous design. Input A can be triggered for controlling the injection temperature of the fluid 1 into the compressor with the fluid 2 with the temperature after compression directly downstream of the separator, as a result of which fluid of a much higher temperature than the fluid 3 after heat recovery can be mixed into input A.

From this alternative system type, the function of the control valves 6 and 7 would change compared to the previous description inasmuch as at this point the control valve 6 assumes the task of preventing cooling of the compressor by an overly low temperature of the fluid 1 at the instant of injection. This would be implemented by the above described supply of fluid 2 at the temperature level after compression through the input A. Control valve 7 controls the fluid temperature 3 after heat recovery, in turn the fluid temperature before injection 1 and after compression 2 also being dependent thereon.

In this system design, alternatively or even in addition there can be a control valve 12 which controls the flow of the medium through the heat exchanger 9. This control can regulate likewise the withdrawal of heat from the fluid and thus the temperature difference between the fluid after compression 2 and the fluid after heat recovery 3. In this respect there is also the possibility here of abandoning a control valve in the system in one alternative design. In this design it would be possible to omit the control valve 6 here if control of the fluid injection temperature were undertaken likewise via the control valve 12.

The invention claimed is:

1. Control for heat recovery (WRG) in a compressor system with liquid injection into a compressor of the compressor system, comprising a fluid circuit, said fluid circuit comprising said liquid injection into the compressor of the compressor system, said fluid circuit further comprising at least one heat exchanger of the WRG, said control further comprising:

upstream of the compressor a compressor-side control valve and downstream of the heat exchanger of the WRG a WRG-side control valve, an electronic control unit, wherein said electronic control unit has as input a desired temperature for a mass flow of the WRG, said control unit further configured to receive as input, data reflecting an actual temperature of the mass flow, said control unit configured to regulate a flow of liquid of the liquid injection to regulate the actual temperature of the mass flow towards the desired temperature by controlling at least one of the control valves with an algorithm, wherein said fluid circuit further comprises said heat exchanger and a bypass channel providing for said liquid of the liquid injection to return back to said compressor without said liquid first passing through said heat exchanger, said WRG-side control valve regulates said flow of liquid of the liquid injection into the heat exchanger and into the bypass channel, wherein said compressor-side control valve has a first input port which is in receiving fluid connection with said bypass channel, said compressor-side control valve having a second input port and an outlet port, wherein said fluid circuit comprises a further heat exchanger, wherein said further heat exchanger has an orientation selected from a group of orientations comprising (1) said further heat exchanger oriented upstream of said WRG-side control valve and (2) said further heat exchanger oriented downstream of said WRG-side control valve, wherein if said further heat exchanger is oriented downstream of the WRG-side control valve then the first input port of the compressor-side control valve receives liquid of the liquid iniection from the compressor without said liquid first passing through said further heat exchanger, and said first input port of said compressor-side control valve is also in receiving fluid connection with the heat exchanger of the WRG, and the second input port of the compressor-side control valve is in receiving fluid connection with said further heat exchanger, wherein if said further heat exchanger is oriented upstream of the WRG-side control valve then the first input port of the compressor-side control valve receives liquid of the liquid infection from the compressor without the liquid first passing through said further heat exchanger or said heat exchanger of said WRG, and said second input port of the compressor-side control valve is in receiving fluid connection with both of said exchangers.

2. Control for heat recovery (WRG) in a compressor system as claimed in claim 1, wherein there are temperature measurement elements for detecting at least a temperature of liquid of the liquid injection after injection into said compressor but upstream of the WRG and for detecting a temperature of liquid of the injection downstream of the WRG, said temperature measurement elements supply measurement data to the control unit.

3. Control for heat recovery (WRG) in a compressor system as claimed in claim 1, wherein there are temperature measurement elements for detecting temperature of the mass flow downstream of the heat exchanger of the WRG and/or a temperature of the mass flow upstream of the heat exchanger of the WRG, said temperature measurement elements for said mass flow supply measurement data to the control unit.

4. Control for heat recovery (WRG) in a compressor system as claimed in claim 1, wherein the desired temperature of the mass flow is a desired temperature of the mass flow downstream of the WRG.

5. Control for heat recovery in a compressor system as claimed in claim 1, wherein said WRG-side control valve has a first input and a second input, said first input receiving liquid of said liquid injection from said compressor without said liquid first passing through said heat exchanger of the WRG, said second input in receiving fluid connection with said heat exchanger of the WRG.

6. Control for heat recovery (WRG) in a compressor system as claimed in claim 1, wherein the liquid is oil.

7. Control for heat recovery (WRG) in a compressor system as claimed in claim 1, wherein the liquid is water.

8. Control for heat recovery (WRG) in a compressor system as claimed in claim 1, wherein the compressor-side control valve is a three-way valve.

* * * * *